US012650057B2

(12) United States Patent
Kharrat et al.

(10) Patent No.: US 12,650,057 B2
(45) Date of Patent: Jun. 9, 2026

(54) MULTICYCLE VALVE SYSTEM

(71) Applicant: SCHLUMBERGER TECHNOLOGY CORPORATION, Sugar Land, TX (US)

(72) Inventors: Houssem Kharrat, Rosharon, TX (US); Mitchell Gamble, Calgary (CA); Austin Chen, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/107,582

(22) PCT Filed: Sep. 8, 2023

(86) PCT No.: PCT/US2023/032275

§ 371 (c)(1),
(2) Date: Feb. 28, 2025

(87) PCT Pub. No.: WO2024/054619

PCT Pub. Date: Mar. 14, 2024

(65) Prior Publication Data

US 2025/0314153 A1 Oct. 9, 2025

Related U.S. Application Data

(60) Provisional application No. 63/375,130, filed on Sep. 9, 2022.

(51) Int. Cl.

| | |
|---|---|
| ***E21B 43/08*** | (2006.01) |
| ***E21B 34/14*** | (2006.01) |
| ***E21B 43/12*** | (2006.01) |

(52) U.S. Cl.

CPC ..... *E21B 34/142* (2020.05); *E21B 43/08* (2013.01); *E21B 43/12* (2013.01); *E21B 2200/06* (2020.05); *E21B 2200/08* (2020.05)

(58) Field of Classification Search

CPC .... E21B 43/12; E21B 34/142; E21B 2200/04; E21B 2200/06; E21B 43/08; E21B 2200/08

(Continued)

(56) References Cited

U.S. PATENT DOCUMENTS

2009/0044944 A1* 2/2009 Murray ..... E21B 43/12 166/308.1
2009/0139726 A1* 6/2009 Gomez ..... E21B 23/04 166/100

(Continued)

OTHER PUBLICATIONS

International Search Report and Written Opinion of International Patent Application No. PCT/US2023/032275 dated on Dec. 28, 2023, 13 pages.

(Continued)

*Primary Examiner* — Matthew R Buck
*Assistant Examiner* — Douglas S Wood
(74) *Attorney, Agent, or Firm* — Jeffrey D. Frantz

(57) ABSTRACT

A system and method for providing improved control of fluid flow between an interior and an exterior of a tubing string with a multicycle valve system. The multicycle valve having a run-in position, a fracturing position, and a production position. The multicycle valve comprising an outer housing having fracturing ports and production ports. The multicycle valve has a fracturing sleeve which is shifted via pressure applied to a first drop dissolvable ball to open fracturing ports of the multicycle valve. Pressure applied to a second dropped ball shifts an intermediate sleeve to close the fracturing ports and shifts a production sleeve to open production ports. The multicycle valve also has a bypass port allows sufficient fluid to exit the multicycle valve such that an additional ball pump-down operations can still take place uphole of the multicycle valve.

14 Claims, 2 Drawing Sheets

(58) Field of Classification Search
USPC ..... 166/373
See application file for complete search history.

(56) References Cited

U.S. PATENT DOCUMENTS

| | | | | |
|---|---|---|---|---|
| 2009/0272544 | A1* | 11/2009 | Giroux | E21B 31/12 166/208 |
| 2011/0192613 | A1* | 8/2011 | Garcia | E21B 34/142 166/373 |
| 2017/0067314 | A1* | 3/2017 | Flores Perez | E21B 34/142 |
| 2017/0130566 | A1* | 5/2017 | McNamee | E21B 34/06 |
| 2018/0347330 | A1* | 12/2018 | Facca | E21B 34/14 |
| 2022/0098945 | A1* | 3/2022 | Wardley | E21B 23/01 |
| 2023/0022332 | A1* | 1/2023 | Macphail | E21B 43/14 |

OTHER PUBLICATIONS

Gomez, R. et al., "Novel Multi-Stage Fracturing Sand Control Technology to Improve Completion Efficiency, Early Production and Reduce Well Cost", IPTC International Petroleum Technology Conference, IPTC-22198-MS, Feb. 2022, 16 pages, Riyadh, Saudi Arabia.

* cited by examiner

MULTICYCLE VALVE SYSTEM

CROSS-REFERENCE TO RELATED APPLICATION

The present document is based on and claims priority to U.S. Provisional Application Ser. No. 63/375,130, filed Sep. 9, 2022, which is incorporated herein by reference in its entirety.

BACKGROUND

In a variety of well applications, a toe valve may be positioned along a casing string to enable selective communication between a wellbore and the surrounding reservoir via circumferential flow ports. In a multistage stimulation, for example, a toe valve may be run at the toe of the casing in a closed position. The toe valve is then actuated to open the circumferential flow ports to provide communication between the interior of the casing and the surrounding reservoir. This allows an operator to run perforation guns, plugs, and other tools via wireline in a horizontal section of the wellbore by pumping fluids down through the casing string. The pumped fluids effectively push the tool or tools along the wellbore before exiting the casing through the flow ports of the toe valve. In some subsequent operations, such as sand control, there is a need to sequentially close one set of ports and open a second set of ports covered by a sand screen assembly.

SUMMARY

In general, a system and methodology providing improved control of fluid flow between an interior and an exterior of a tubing string. The improved control of fluid is accomplished with a multicycle valve system. For purposes of explanation, the multicycle valve system is described in the form of a triple sleeve valve system positioned along the tubing string.

The multicycle valve having a run-in position, a fracturing position, and a production position. The multicycle valve comprising an outer housing having fracturing ports and production ports A fracturing sleeve positioned within the outer housing to prevent flow between a bore of the multicycle valve and an exterior of the housing via the fracturing port when the valve is in the run-in position and allow flow between the bore and the exterior via the fracturing port when the valve is shifted to the fracturing position. An intermediate sleeve positioned within the outer housing to prevent flow between the bore and the exterior via the fracturing ports when the valve is shifted from at least one of the run-in position or the fracturing position to the production position. A production sleeve positioned within the outer housing to prevent flow between the bore and the exterior via the production ports when the valve is in at least one of the run-in position or the fracturing position and allow flow between the bore and the exterior via the production ports when the valve is shifted from at least one of the run-in position or the fracturing position to the production position.

A method for producing hydrocarbons from a well, the method comprising disposing a tubular string comprising a multicycle valve within a wellbore. Shifting a fracturing sleeve of the multicycle valve via pressure applied to a first drop dissolvable ball to open fracturing ports of the multicycle valve. Shifting an intermediate sleeve of the multicycle valve and a production sleeve of the multicycle valve via pressure applied to a second drop dissolvable ball to close the fracturing ports with the intermediate sleeve and open production ports of the multicycle valve.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

Figure 1:
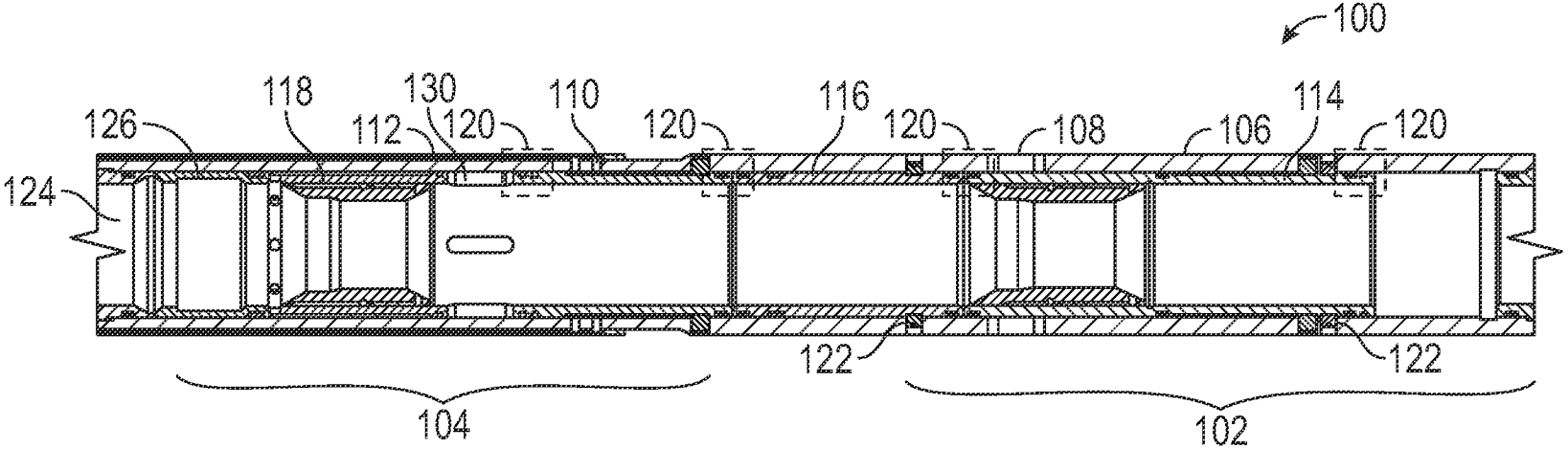
FIG. 1 is a cross-sectional diagram of a multicycle valve system in a first position according to an embodiment of the disclosure.

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

The disclosure herein generally involves a system and methodology providing improved control of fluid flow between an interior and an exterior of a tubing string, e.g. improved communication between a wellbore and a surrounding reservoir. According to an embodiment, a multicycle valve system may be positioned along a casing string or other type of tubing string and may easily be actuated multiple times between closed flow and open flow positions. For purposes of explanation, the multicycle valve system is described in the form of a toe valve system and a multicycle valve positioned in various zones above the toe valve along the tubing string. However, the multicycle valve system may have other configurations and may be used in other types of operations or at other locations along a tubing string.

As described in greater detail below, an initial activation may occur when a drop ball, plug, or similar tool is seated and a pressure increase along the interior of the tubing string is used to initially open one or more fracturing ports of the toe valve system, thus allowing radial flow between an interior and an exterior of the tubing string. After the initial activation, a drop ball, plug, or similar tool may be used to close the fracturing ports and open one or more production ports covered by a sand screen assembly.

Referring now to FIG. 1, FIG. 1 is a cross-sectional diagram of a multicycle valve 100 in a first position or run-in position according to an embodiment of the disclosure. In this embodiment, the multicycle valve 100 is described as having a fracturing portion 102 and a production portion 104 disposable along a tubing string. However, the valve system 100 may have other multicycle valve system configurations for use in other types of operations, tubing strings, and/or locations along the tubing string. For example, the tubing string may be in the form of a casing string, which may be positioned within a borehole, e.g. a wellbore.

A borehole is drilled into a surrounding reservoir, and the multicycle valve 100 controls fluid communication between the tubing string and the surrounding reservoir. In other words, the multicycle valve 100 may be operated to control fluid flow between a bore and an exterior of the tubing string when the tubing string is positioned within a borehole. Depending on the parameters of specific operations, the size, components, and materials used in the construction of tubing string, as well as multicycle valve 100, may be changed or adjusted.

In the illustrated embodiment, the multicycle valve 100 comprises an outer housing 106 having at least one fracturing port 108 and at least one production port 110 that each enable fluid flow between a bore 124 of the multicycle valve 100 and an exterior of the multicycle valve 100. In some embodiments, the outer housing 106 may comprise a plurality of outer housings, such as an upper housing coupled with a lower housing. Additionally, there may be a plurality of fracturing ports 108 and production ports 110 that allow fluid flow between the bore 124 of the multicycle valve 100 and the exterior of the multicycle valve 100 and thus between the bore and exterior of the overall tubing string. In some embodiments, the plurality of ports fracturing ports 108 and production ports 110 may be oriented in a generally radial direction through the outer housing 106 and may be arranged along a circumference of the outer housing 106. Further, the multicycle valve 100 may include a screen 112 covering the production ports 110. In one or more embodiments, an inflow control device may be used with the screen 112.

Figure 2:
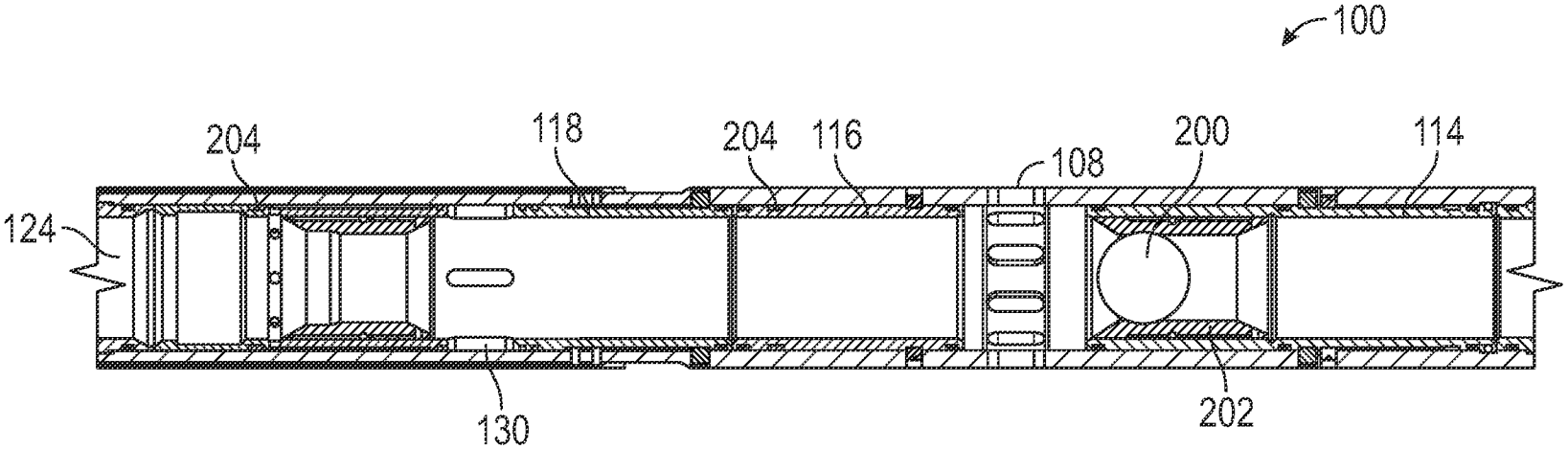
FIG. 2 is a cross-sectional diagram of the multicycle valve of FIG. 1 in a second position.
Figure 3:
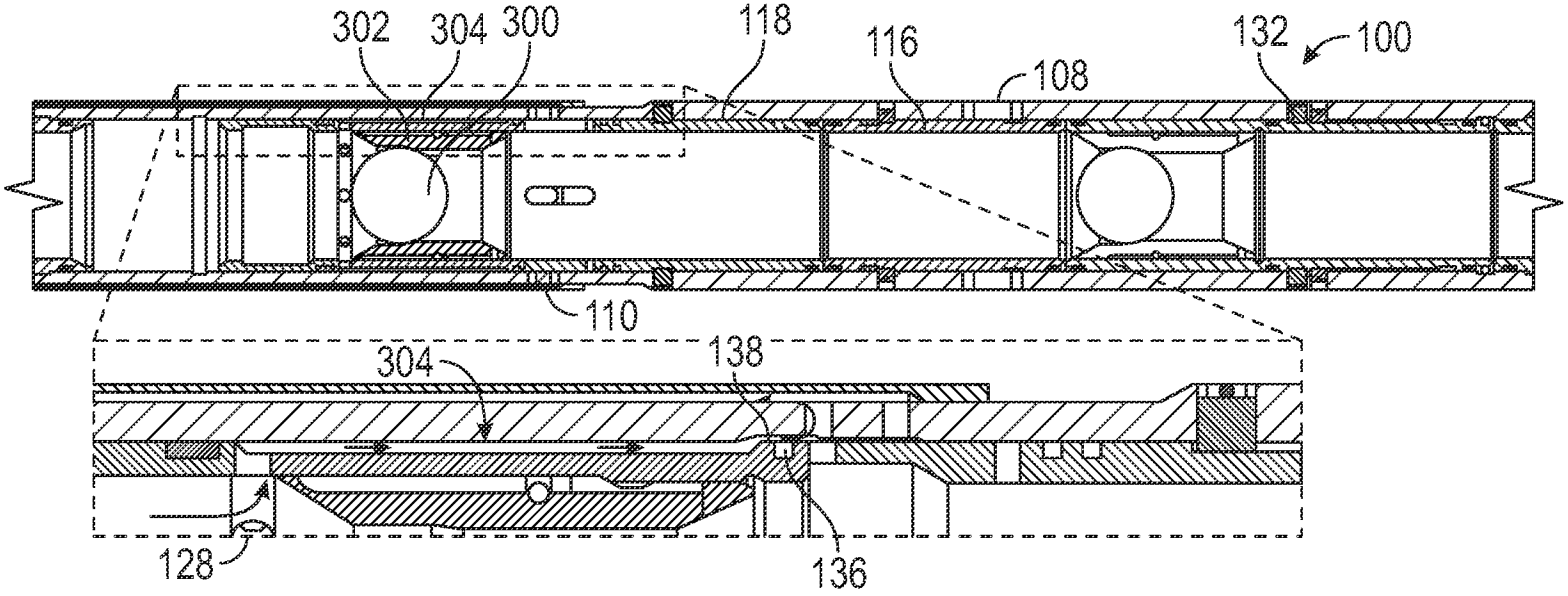
FIG. 3 is a cross-sectional diagram of the multicycle valve of FIG. 1 in a third position.
Figure 4:
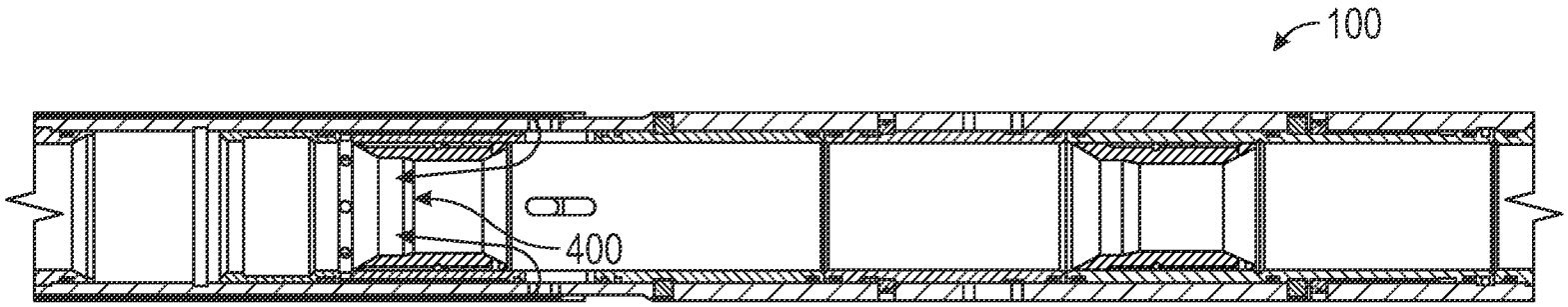
FIG. 4 is a cross-sectional diagram of the multicycle valve of FIG. 3 once the drop balls have dissolved.

The multicycle valve 100 further comprises a fracturing sleeve 114, an intermediate sleeve 116, and a production sleeve 118 all slidably mounted within the outer housing 106 for movement between closed positions, shown in FIG. 1, and open positions, show in FIGS. 2-4 and described in more detail below. Seals 120 located about circumference of each of the sleeves 114, 116, 118 and oriented to form a sealing engagement with an interior surface of the outer housing 106. In the closed position, the fracturing sleeve 114 is located to cover the fracturing ports 108 with the seals located on both sides of ports 108, thus preventing flow into the bore 124 through the fracturing ports 108. Also, the production sleeve 118 covers the production ports 110 in the closed position with seals 120 located on the production sleeve. The fracturing sleeve 114 and intermediate sleeve 116 both are solid with no ports, while the production sleeve 118 has sleeve ports 130. When actuated the sleeve ports 130 are aligned with the production ports 110 allowing fluid flow between the bore 124 of the multicycle valve 100 and the exterior of the multicycle valve 100.

The multicycle valve 100 has anti-rotation mechanism 132 between one or more sleeves 114, 116, 118 and the outer housing 106. The anti-rotation mechanism 132 is a pin or key on the inner surface of the outer housing 106 that slides in a slot on the outer surface of the one or more sleeves 114, 116, 118. The components of the anti-rotation mechanism 132 can be reversed so that the pin or key is outer surface of the sleeves 114, 116, 118 and the slot is on the inner surface of the outer housing. The anti-rotation mechanism can be any other mechanism that prevents rotation of the sleeves 114, 116, 118. The purpose of the has anti-rotation mechanism 132 is to prevent rotation of the sleeves 114, 116, 118. Also, the anti-rotation mechanism 132 prevent the sleeves 114, 116, 118 from rotating if the sleeves 114, 116, 118 need to be milled.

A retention mechanism 204 may be used to maintain sleeves 114, 116, 118 in an open or closed position. In this embodiment, the retention mechanism 204, such as a C-ring or ratchet mechanism, retains the fracturing sleeve 114 in the shifted position. The C-ring may be flexed radially outward to be held in a locking groove. The ratchet mechanism will allow linear motion in only one direction while preventing linear motion in the opposite direction. Additionally, retention mechanism 204, such as a detent ring, may be associated with the production sleeve 118 and intermediate sleeve 116 to maintain the production sleeve 118 and intermediate sleeve 116 in actuated position. The detent will correspond to a groove in the outer housing 106.

A bypass flow path 304 is created between the outer housing 106 and the production sleeve 118. The bypass flow path 304 is a channel that allows fluid to bypass the upper sleeve 118 and a dissolvable ball 300 seated in a seat 302 of the upper sleeve 118 to allow fluid flow through a production port 110. The bypass flow path 304 helps facilitate pumping down balls to the multicycle valves 100 in stages above the current multicycle valve 100. The production sleeve 118 has a sacrificial seal 136. The sacrificial seal 136 creates a seal between the production sleeve 118 and the outer housing 106 in the run-in position of the production sleeve 118. Once the production sleeve 118 is shifted, the sacrificial seal 136 no longer creates a seal between the production sleeve 118 and the outer housing 106 because the seal is in a recessed section 138 of the outer housing 106 as illustrated in FIG. 3.

The multicycle valve 100 may initially be held in the closed position via shear pins 122 extending between one or more of the sleeves 114, 116, 118 and the outer housing 106. When the multicycle valve 100 reaches the desired location within the wellbore, a dissolvable ball 200 may be dropped and contact a seat 202 of the fracturing sleeve 114, as shown in FIG. 2. Pressure can then be applied within the bore of the multicycle valve 100 to shift the fracturing sleeve 114 to a fracturing position and open the fracturing ports 108, allowing fracturing operations to occur. Once the fracturing sleeve 114 is fully shifted, the retention mechanism 204 may be used to retain the fracturing sleeve 114 in the shifted position. Additional retention mechanisms, such as detent rings 204 may be used to retain the intermediate sleeve 116 and production sleeve 118 in the initial, closed positions.

Once fracturing operations are completed, a dissolvable ball 300 may be dropped and contact the seat 302 of the production sleeve 118. Pressure can then be applied within the bore of the multicycle valve 100 to shift the production sleeve 118 and intermediate sleeve 116 to a production position closing the fracturing ports 108 and opening the production ports 110. The intermediate sleeve 116 will close the fracturing ports 108. Opening the production ports 110 also opens the bypass flow path 304 around the production sleeve 118 and the dissolvable ball 300. The bypass flow path 304 allows sufficient fluid to exit the multicycle valve 100 such that an additional ball pump-down operations can still take place uphole of the multicycle valve 100. After a period of time, the dissolvable ball 300 dissolves sufficiently to allow production of reservoir fluids through the multicycle valve 100, as shown in FIG. 4.

The drop ball actuation of the production sleeve 118 and intermediate sleeve 116 enables timed closing of fracturing port 108 and opening of the production port 110 avoiding hydraulic lock. The Production port 110 opens before the fracturing ports 108 close preventing hydraulic lock. Additionally, the fluid pressure required to shift the production sleeve 118 and intermediate sleeve 116 is equal or less than the fluid pressure needed to shift the fracturing sleeve 114.

In one or more embodiments, the multicycle valve 100 may also include a profile 400 on the internal surface of the production sleeve 118. The profile can be located at various positions on the internal surface of the production sleeve 118. The profile 400 may be shaped to engage a shifting tool, such as a coiled tubing shifting tool, such that the shifting tool can shift the production sleeve 118 back to the closed position shown in FIG. 1. A linear force applied by the shifting tool allows for the disengagement of the retention mechanism 204 so that the production sleeve 118 can slide between an open and closed position. The production sleeve 118 can be open and closed multiple times within the life of the well. Additionally, although the embodiments described above utilize a ball to shift the sleeves 114, 116, 118, the invention is not thereby limited. Darts may be used to shift the fracturing sleeve 114 and/or the production sleeve 118. Further, the fracturing sleeve 114 may be shifted by other means, such an electronic actuator.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A multicycle valve having a run-in position, a fracturing position, and a production position, the multicycle valve comprising:

an outer housing having fracturing ports and production ports;

a fracturing sleeve positioned within the outer housing to prevent flow between a bore of the multicycle valve and an exterior of the housing via the fracturing port when the multicycle valve is in the run-in position and allow flow between the bore and the exterior via the fracturing port when the multicycle valve is shifted from the run-in position to the fracturing position;

an intermediate sleeve positioned within the outer housing to prevent flow between the bore and the exterior via the fracturing ports when the valve is shifted from the fracturing position to the production position;

a production sleeve positioned within the outer housing to prevent flow between the bore and the exterior via the production ports when the multicycle valve is in at least one of the run-in position or the fracturing position and allow flow between the bore and the exterior via the production ports when the multicycle valve is shifted from the fracturing position to the production position; and a bypass flow path between the outer housing and the production sleeve, wherein the bypass flow path allows fluid to bypass the upper sleeve.

2. The multicycle valve of claim 1, further comprises a screen covering the production ports.

3. The multicycle valve of claim 1, wherein the fracturing sleeve is shifted via pressure applied to a first drop dissolvable ball to open fracturing ports.

4. The multicycle valve of claim 1, wherein the intermediate sleeve and the production sleeve are shifted via pressure applied to a second drop dissolvable ball to close fracturing ports and open the production ports.

5. The multicycle valve of claim 1, wherein the multicycle valve is initially held in the closed position via shear pins extending between one or more of the fracturing sleeve, the intermediate sleeve and production sleeve and the outer housing.

6. The multicycle valve of claim 1, further comprises seals located about circumference of each of the fracturing sleeve, the intermediate sleeve and production sleeve;

wherein a sacrificial seal creates a seal between the production sleeve and the outer housing in the run-in position and the sacrificial seal no longer creates in the seal in the production position.

7. The multicycle valve of claim 1, further comprising a retention mechanism for maintaining the fracturing sleeve in a shifted position.

8. The multicycle valve of claim 1, wherein the production sleeve has a profile for shifting the production sleeve with a shifting tool.

9. The multicycle valve of claim 1, wherein the multicycle valve is positioned on a tubing string.

10. The multicycle valve of claim 1, wherein the production sleeve may be actuated multiple times between an open position and closed position.

11. A method for producing hydrocarbons from a well, the method comprising:

disposing a tubular string comprising a multicycle valve within a wellbore;

shifting a fracturing sleeve of the multicycle valve via pressure applied to a first drop dissolvable ball to open fracturing ports of the multicycle valve;

shifting an intermediate sleeve of the multicycle valve and a production sleeve of the multicycle valve via pressure applied to a second drop dissolvable ball to close the fracturing ports with the intermediate sleeve and open production ports of the multicycle valve; and opening a bypass flow path when the production sleeve is shifted, the bypass flow path is between the outer housing and the production sleeve, wherein the bypass flow path allows sufficient fluid to exit the multicycle valve such that an additional ball pump-down operations can still take place uphole of the multicycle valve.

12. The method for producing hydrocarbons from the well of claim 11, wherein the ball dissolves to allow production of fluid through the production ports of the multicycle valve.

13. The method of claim 11, further comprises closing the production ports by shifting the production sleeve with a shifting tool engaged with profile of the production sleeve.

14. The method for producing hydrocarbons from the well of claim 11, further comprises a screen covering the production ports.

* * * * *